US007979015B2

(12) United States Patent
Matsunaka et al.

(10) Patent No.: US 7,979,015 B2
(45) Date of Patent: Jul. 12, 2011

(54) HEAT FIXING MEMBER AND HEAT FIXING ASSEMBLY

(75) Inventors: Katsuhisa Matsunaka, Inagi (JP); Kazuo Kishino, Yokohama (JP); Yoko Kuruma, Mishima (JP); Masaaki Takahashi, Odawara (JP)

(73) Assignee: Canon Kabushiki Kaisha (JP)

( * ) Notice: Subject to any disclaimer, the term of this patent is extended or adjusted under 35 U.S.C. 154(b) by 509 days.

(21) Appl. No.: 12/123,882

(22) Filed: May 20, 2008

(65) Prior Publication Data

US 2008/0219729 A1 Sep. 11, 2008

Related U.S. Application Data

(63) Continuation of application No. 11/358,262, filed on Feb. 21, 2006, now Pat. No. 7,457,577.

(30) Foreign Application Priority Data

Feb. 21, 2005 (JP) ..... 2005-043905
Feb. 21, 2005 (JP) ..... 2005-043984

(51) Int. Cl.
*G03G 15/20* (2006.01)

(52) U.S. Cl. ..... 399/333

(58) Field of Classification Search ..... 399/330, 399/333

See application file for complete search history.

(56) References Cited

U.S. PATENT DOCUMENTS

| | | | |
|---|---|---|---|
| 6,002,910 | A | 12/1999 | Eddy et al. |
| 6,122,479 | A | 9/2000 | Fujita et al. |
| 6,405,013 | B2 | 6/2002 | Haneda et al. |
| 2005/0214044 | A1 | 9/2005 | Sakakibara et al. |

FOREIGN PATENT DOCUMENTS

| | | | |
|---|---|---|---|
| JP | 2002-268423 | A | 9/2002 |
| JP | 2002-351243 | A | 12/2002 |
| JP | 2005292218 | A | 10/2005 |

*Primary Examiner* — David Gray
*Assistant Examiner* — Gregory H Curran
(74) *Attorney, Agent, or Firm* — Rossi, Kimms & McDowell LLP

(57) ABSTRACT

In a heat fixing member which is a seamless type cylindrical heat fixing member having an elastic layer, the elastic layer is mixed with carbon fibers, and the elastic layer has a thermal conductivity of 1.0 W/(m·K) or more in the thickness direction thereof. A heat fixing member is provided which is more improved in the thermal conductivity in the thickness direction, can efficiently supply heat to the heating object (recording medium) at the time of high-speed printing, can give fixed images having a high glossiness in virtue of the elastic layer, which has secured a sufficient flexibility. A high-performance heat fixing assembly is also provided which can conduct sufficient heat to toner images even if the dwell time is shortened.

7 Claims, 2 Drawing Sheets

HEAT FIXING MEMBER AND HEAT FIXING ASSEMBLY

This is a continuation of U.S. patent application Ser. No. 11/358,262 filed Feb. 21, 2006.

BACKGROUND OF THE INVENTION

1. Field of the Invention

This invention relates to a heat fixing member used in a heat fixing assembly which heats a sheetlike recording medium sandwichedly transported to a pressure contact nip zone formed between a heat fixing member and a pressure member and melts unfixed toner images held on the recording medium, to fix the former to the latter; and a heat fixing assembly having the heat fixing member.

2. Related Background Art

In general, in heat fixing assemblies used in electrophotographic systems, a heating roller and other roller are kept in pressure contact with each other, or a film or belt held on a pressure stay having a heating unit and a roller are kept in pressure contact with each other. Then, the heating roller, film or belt and other roller are synchronously rotated. The recording medium holding thereon the unfixed toner images is guided into the pressure contact zone and heated, where the unfixed toner images are melted and thereafter cooled and solidified, whereupon the toner images are fixed onto the recording medium.

The roller, film or belt on the side with which the unfixed toner images held on the recording medium comes into contact is called a heat fixing member, which is called a fixing roller, a fixing film, a fixing belt or so according to its form.

Such a heat fixing member is commonly provided on its inside with a heat-generating mechanism as a heat source. Then, heat is supplied from the inner surface side to heat the recording medium kept in contact with the outermost surface of the heat fixing member.

As the heat fixing member, it is often a member constituted basically of a roller-, film- or belt-shaped substrate and formed thereon a heat-resistant elastic layer in a single layer or a plurality of layers.

This elastic layer is often formed of a heat-resistant rubber material such as a silicone rubber or a fluorine rubber. Since, however, such a heat-resistant rubber material has a poor thermal conductivity, it comes resistant to heat when the heat from the heat source is transmitted to the recording medium. Accordingly, in order to make the heat-resistant rubber material improved in thermal conductivity, it is attempted to compound inorganic particles having a high thermal conductivity, such as alumina particles, zinc oxide particles and silicon carbide particles to secure heat conduction performance of the elastic layer. This is effective to a certain extent, but is insufficient in some points in order to be adaptable to high-speed processing in recording apparatus available in recent years.

Accordingly, as disclosed in Japanese Patent Application Laid-open No. 2002-268423, a method is proposed in which a silicone rubber is used as a rubber for the elastic layer of the heat fixing member, and gaseous-phase process carbon fibers are compounded thereinto in a small quantity to attempt to prevent oxidation degradation and improve thermal conductivity. As also disclosed in Japanese Patent Application Laid-open No. 2002-351243, a method is also proposed in which carbon fibers are mixed in the elastic layer to improve thermal conductivity in the lengthwise direction of the roller and improve temperature distribution in the lengthwise direction so as to obtain uniform fixed images.

However, in the method disclosed in Japanese Patent Application Laid-open No. 2002-268423, the interiors of the gaseous-phase process carbon fibers stand hollow, and hence it has been unable to secure thermal conductivity high enough to be adaptable to high-speed processing. Also, in the method disclosed in Japanese Patent Application Laid-open No. 2002-351243, the carbon fibers are oriented in the lengthwise direction with respect to the member, and hence, although the thermal conductivity in the lengthwise direction is secured, any heat flow paths for improving heat conduction properties are not formed in the thickness direction. Hence, it has still been unable to secure any sufficient thermal conductivity. As the result, in either case, the amount of heat to be imparted to the heating object (recording medium) may come insufficient at the pressure contact zone in the fixing assembly, so that the unfixed toner images are not well melted where its pressure contact zone dwell time (or simply "dwell time") is short because of the processing made high-speed, resulting in an insufficient glossiness (or gloss) of images. There has been such a problem.

In recent years, image forming apparatus have been made high-speed and compact, where it is demanded for the heat fixing assembly to be adaptable to the dwell time having been more shortened, and for the heat fixing member it is desired to be more improved in its heat conduction from the heat source to the heating object.

SUMMARY OF THE INVENTION

An object of the present invention is to provide a heat fixing member which is more improved in the thermal conductivity in the thickness direction of an elastic layer, can efficiently supply heat to the heating object (recording medium) and, even at the time of high-speed printing, can give fixed images having a high glossiness.

Another object of the present invention is to provide a heat fixing member which can give uniform images.

Still another object of the present invention is to provide a high-performance heat fixing assembly which can conduct sufficient heat to the unfixed toner images even if the dwell time is shortened.

To achieve the above objects, the present invention provides a heat fixing member which is a seamless type cylindrical heat fixing member having an elastic layer; the elastic layer being mixed with carbon fibers, and the elastic layer having a thermal conductivity of 1.0 W/(m·K) or more in the thickness direction thereof.

The present invention also provides a heat fixing assembly having the above heat fixing member.

DETAILED DESCRIPTION OF THE PREFERRED EMBODIMENTS

Figure 1:
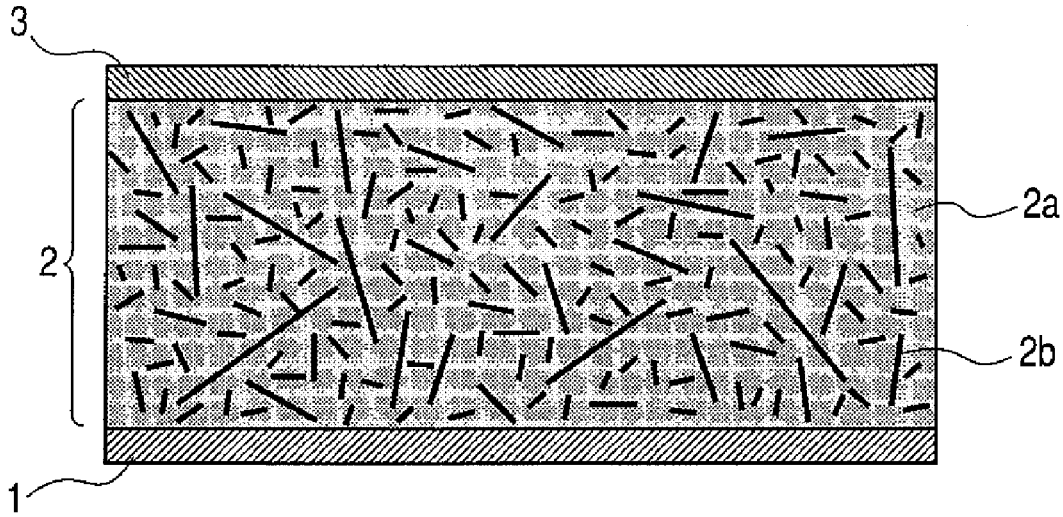
FIG. 1 is a partial sectional view showing a layer structure of the heat fixing member.

In FIG. 1, which is a partial sectional view showing the layer structure of the heat fixing member of the present invention, reference numeral 1 denotes a substrate made of a material having good heat resistance and mechanical strength, and an elastic layer 2 is formed thereon. Then, on the elastic layer 2, a surface layer 3 (a release layer) is further formed which is optionally be provided.

The substrate 1 is a roll-shaped or belt-shaped, seamless type cylindrical substrate. As materials therefor, there are no particular limitations thereon as long as they are materials having good heat resistance and mechanical strength. For example, in the case of the roll-shaped member, usable are metals such as aluminum, iron, copper and nickel; alloys such as stainless steel and brass; and ceramics such as alumina and silicon carbide. Materials for substrates suitable for the belt-shaped member may include, besides the foregoing, e.g., resin materials such as polyethylene terephthalate, polybutylene naphthalate, polyester, thermosetting polyimide, thermoplastic polyimide, polyamide, polyamide-imide, polyacetal and polyphenylene sulfide. Incidentally, to the resin for the substrate, a conductive powder such as metal powder, conductive oxide powder or conductive carbon may be added to keep the resin provided with conductivity. In particular, a polyimide film with carbon black added thereto is preferred.

The elastic layer 2 is formed on the substrate 1 in a uniform thickness, and may be used in any thickness and shape useful as the heat fixing member. Then, in the present invention, it is essential for the elastic layer to be formed in the state that carbon fibers 2*b* are dispersed in a heat-resistant elastic material 2*a* (see FIG. 1).

As the heat-resistant elastic material 2*a*, a heat-resistant rubber material such as a silicone rubber or a fluorine rubber may be used. In the case when the silicone rubber is used as the heat-resistant elastic material, an addition type silicone rubber is preferred from the viewpoint of being readily available and readily processable. Incidentally, before a raw-material rubber is cured, if it has too low a viscosity, sagging may occur at the time of processing, and, if it has too high a viscosity, it is difficult for the material to be mixed and dispersed. Accordingly, a raw-material rubber having a viscosity of about 0.1 to 1,000 Pa·s is preferred. What is practically usable is a raw-material rubber having viscosity in the range of from 50 to 500 Pa·s.

Figure 4:
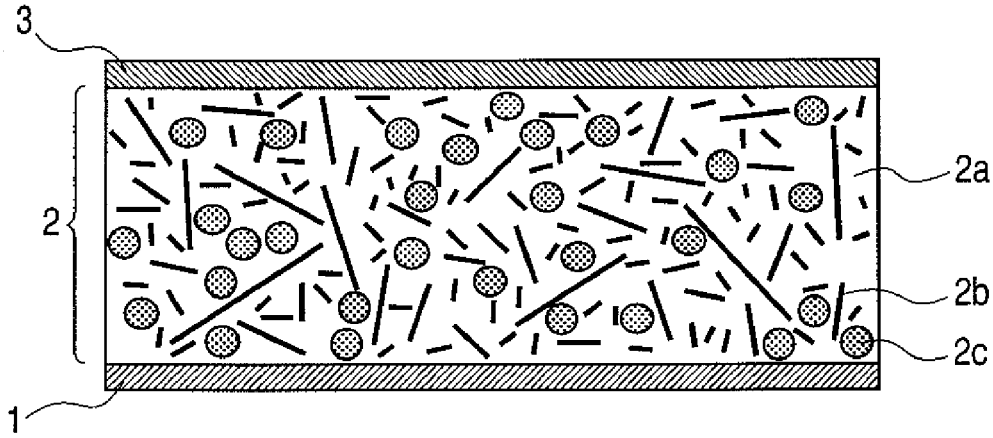
FIG. 4 is a partial sectional view showing another layer structure of the heat fixing member.

The carbon fibers 2*b* have the function as a filler for securing the thermal conductivity of the elastic layer, and may be dispersed in the elastic material to thereby form heat flow paths to enable efficient supply of heat from the heat source side to the heating object (recording medium). Also, the carbon fibers have the shape of fibers, and hence, when kneaded with a liquid elastic material having not been cured, the carbon fibers tend to come oriented in the direction of flow, i.e., in the plane direction when the elastic layer is formed. In such a case, although the elastic layer can be improved in thermal conductivity in its plane direction, the elastic layer may be less improved in thermal conductivity in its thickness direction. Accordingly, it is preferable to keep the carbon fibers from coming oriented to improve the thermal conductivity in the thickness direction. In the present invention, in addition to the addition of the carbon fibers, an orientation inhibitory component 2*c* such as silica, alumina or iron oxide may preferably be added as shown in FIG. 4, in order to inhibit the carbon fibers from coming oriented. The use of such an orientation inhibitory component enables improvement in thermal conductivity in the thickness direction of the elastic layer without adding the carbon fibers in excess. A protective material for the heat-resistant elastic material, such as a heat stabilizer or an antioxidant may also be added to the elastic layer.

As the shape of the carbon fibers, the carbon fibers may preferably have an average fiber diameter D of 1 μm or more from the viewpoint of securing thick heat flow paths, and an average fiber length L of 1 μm or more from the viewpoint of forming long heat flow paths. Also, in order to relax the orientation when the elastic layer is formed, in carbon fibers having fiber length of 1 μm or more, fibers having fiber length in the range of from 1 to 50 μm may preferably account for 80% or more by number, and further the fibers having fiber length in the range of from 1 to 50 μm may preferably account for from 80 to 95% by number. That is, those having the average fiber diameter D of 1 μm or more can improve the flow of heat in the elastic layer, and those having the average fiber length L of 1 μm or more can elongate the heat flow paths in the elastic layer to improve the thermal conductivity of the elastic layer. Also, those in which the number of fibers of from 1 to 50 μm in fiber length is 80% or more can make the orientation of carbon fibers relaxed when the elastic layer is formed, to improve the thermal conductivity in the thickness direction. Further, those in which the number of fibers of from 1 to 50 μm in fiber length is 80 to 95% can efficiently prevent the elastic layer from coming hard.

Such carbon fibers may preferably be, in view of their heat conduction performance, pitch-based carbon fibers are preferred which are produced using petroleum pitch or coal pitch as a raw material. It is further preferable to use those having the value of true density of 2.1 g/cm$^3$ or more, which have a high purity and in which their internal graphite crystal structure is densely formed. The use of the pitch-based carbon fibers brings an improvement in heat conduction performance through the heat flow paths in the elastic layer. In general, those having a true density of approximately from 1.5 to 2.0 g/cm$^3$ are largely on the market. In the present invention, in particular, carbon fibers having a true density of 2.1 g/cm$^3$ or more may be used, in which their carbon crystal structure has been made dense. This enable further improvement in heat conduction performance through the heat flow paths in the elastic layer. Incidentally, the true density of carbon fibers may be measured with, e.g., a dry-process automatic densitometer (trade name: ACCUPYC 1330-1, manufactured by Shimadzu Corporation).

The orientation inhibitory component 2*c* which may be compounded together with the carbon fibers may be exemplified by metal oxides (e.g., aluminum oxide, zinc oxide and quartz), metal nitrides (e.g., boron nitride and aluminum nitride), metal carbides (e.g., silicon carbide) and metal hydroxides (e.g., aluminum hydroxide). Then, these may be used in a powdery form, a granular form, a fibrous form, a scaly form, a spherical form, an acicular form, a whiskery form or a tetrapod form. In particular, granular aluminum oxide (alumina) may more preferably be used because of its high thermal conductivity, uniformity in shape, and readiness of being compounded in the elastic material (e.g., silicone rubber).

Incidentally, to achieve the inhibition of orientation of carbon fibers effectively, it is preferable to give a relationship of $0.5 \leqq R/D \leqq 10$ where the weight-average particle diameter of the orientation inhibitory component such as aluminum oxide particles is represented by R (μm) and the average fiber diameter of the carbon fibers by D (μm). Setting the weight-average particle diameter R of the orientation inhibitory component so as to satisfy the above relationship makes it unnecessary to fill particles in a large quantity in order to inhibit the orientation of the carbon fibers, and makes it able to well secure the heat flow paths attributable to the carbon fibers. More specifically, bringing the average fiber diameter D of the carbon fibers and the weight-average particle diameter R of the orientation inhibitory component into the above relationship enables formation of an elastic layer having a lower hardness, and this enables, while securing a good image uniformity, more relaxation of the orientation of carbon fibers when the elastic layer is formed, and enables effective improvement in thermal conductivity in the thickness direction of the elastic layer.

The weight-average particle diameter R of the orientation inhibitory component may be measured with, e.g., a laser beam diffraction particle size distribution measuring instrument (trade name: SALD-7000 manufactured by Shimadzu Corporation). Also, the average fiber diameter D of the carbon fibers may be measured with, e.g., a flow type particle image analyzer (trade name: FPIA-3000, manufactured by Sysmex Corporation).

As to the amount of compounding the carbon fibers and the orientation inhibitory component, it is preferable that the fill by volume of the total of these is 20 to 60% based on the volume of the elastic material. This enables the elastic layer to be endowed with sufficient thermal conductivity in its thickness direction while preventing the elastic layer from having a high hardness.

As a method for ascertaining the number distribution of the carbon fibers, it may be ascertained by measuring with a scanning electron microscope the fiber length of at least 1,000 fibers in respect of those of 1 μm or more in fiber length which are embraced in an arbitrary visual field angle. Also, the number distribution of carbon fibers contained in the elastic material may be ascertained by a method shown below. That is, it may be ascertained in the following way: A test piece of the elastic layer containing the carbon fibers is put into an aluminum container, in the state of which it is put into a maffle furnace, and is heated at 500° C. for 1 hour. Thereafter, residues in the aluminum container are taken out and are subjected to ultrasonic stirring and filtration in methyl ethyl ketone. Carbon fibers contained in the filtrate obtained are measured on the scanning electron microscope in the same way. Incidentally, in the present invention, the carbon fibers are measured from their photographed image by using an image analyzing software IMAGE-PRO PLUS (trade name), manufactured by Media Cybernetics, Inc. In regard to the amount in which the carbon fibers and the orientation inhibitory component which are contained in the elastic material have been compounded, too, it may be ascertained by the above method and using the scanning electron microscope.

There are no particular limitations on how to form the elastic layer 2. Commonly usable are forming methods such as molding and coating. It may also be formed by the ring coating method disclosed in Japanese Patent Applications Laid-open No. 2003-190870 and No. 2004-290853. By this method, the elastic layer can be formed in a seamless form. Incidentally, the elastic layer may preferably have a thickness of from 0.05 to 5 mm, which may preferably be, e.g., about 2 mm.

From the viewpoint of securing the uniformity of fixed images, the elastic layer may preferably be one having a hardness of from 1 to 50 degrees as hardness measured with an ASKER-C type hardness meter (trade name; manufactured by Kobunshi Keiki Co., Ltd.) according to JIS K 7312 or SRIS0101 standard (hereinafter "ASKER-C hardness"). Controlling the ASKER-C hardness of the elastic layer within this range makes it easy for the elastic layer of the heat fixing member to follow up unevenness (hills and dales) of the recording medium and toner images, and this can secure a sufficient image uniformity. Incidentally, in the case of a sample which can not secure a thickness that is enough to measure the ASKER-C hardness, only the elastic layer is cut out and several layers are piled up to measure their ASKER-C hardness.

In regard to the thermal conductivity in the thickness direction of the elastic layer, it may be measured with a steady-state thermal conductivity measuring instrument AUTO-A HC-110 (trade name; manufactured by Eko Instruments Co., Ltd.). Here, the temperature of upper and lower plates is set at 25 plus-minus 2° C. If necessary, several layers are so piled up as to make no air space, to prepare a sample, and the sample is so set as to be 6 mm or more in sample thickness to make measurement. Incidentally, an average value of values measured on the upper and lower plates is employed as the thermal conductivity of the elastic layer.

For the elastic layer in the heat fixing member of the present invention, it is essential to have a thermal conductivity of 1.0 W/(m·K) or more in the thickness direction thereof, and more preferably to have a thermal conductivity of 2.0 W/(m·K) or more. In as much as the elastic layer has a thermal conductivity of 1.0 W/(m·K) or more in its thickness direction, a good glossiness performance can be achieved even at the time of high-speed printing, and the thermal conductivity may more preferably be 2.0 W/(m·K) or more.

The release layer 3 is often formed of a silicone rubber, a fluorine rubber, a fluorine resin or the like. From the viewpoint of releasability, the fluorine resin is preferred. As methods for its formation, commonly available are, but not particularly limited to, a method in which the elastic layer 2 is covered with a release layer material formed into a seamless tube, and a method in which the elastic layer 2 is coated on its outer surface with material fine particles or a liquid dispersion thereof, followed by heating and melting to form a film. The release layer may also preferably have a thickness of, but not particularly limited to, from 5 to 100 pin.

A primer layer or an adhesive layer may further be formed between the respective layers for the purpose of adhesion, electrical conduction and so forth. Also, the respective layers may be constituted of multiple layers. On the inner surface and/or outer surface of the heat fixing member, a layer or layers other than those shown herein may also be formed for the purpose of providing slidability, heat absorption properties, heat generation properties, releasability and so forth. In particular, in the case of the belt-shaped member, a layer of polyimide, polyamide-imide, fluorine resin or the like may be provided on the inner surface of its base layer, in order to improve its slidability. The order in which these layers are formed is not particularly limited, and the layers may be formed in the order appropriately changed on account of circumstances of the respective steps and so forth.

The heat fixing assembly, which has the heat fixing member of the present invention, is described below.

Figure 2:
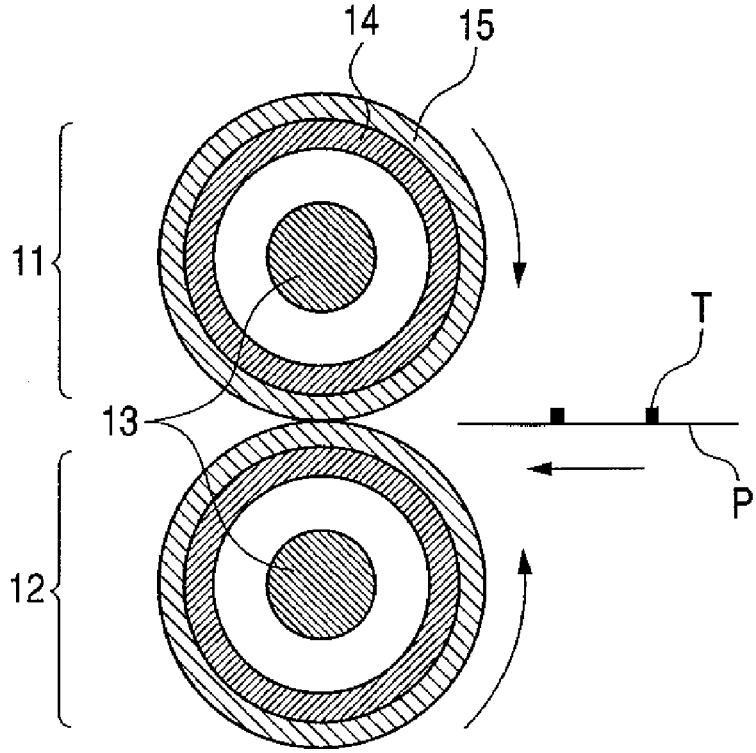
FIG. 2 is a diagrammatic sectional view of a heat fixing assembly making use of a roller-shaped heat fixing member.

In FIG. 2, a heat fixing assembly making use of a roller-shaped heat fixing member as the heat fixing member is shown as its diagrammatic sectional view.

This heat fixing assembly comprises a pair of rotatable rollers consisting of a fixing roller 11 which is the heat fixing member, and a pressure roller 12 kept in pressure contact with the fixing roller 11. A nip is formed between these rollers. These rollers are each also built-in provided with a heater 13 serving as a heat source. In such a heat fixing assembly, where, e.g., the fixing roller 11 and the pressure roller 12 are both 60 mm in outer diameter, the nip width is usually set at 5 to 10 mm.

On the side of the fixing roller 11, the heat fixing assembly may be provided with an oil application assembly which applies silicone oil or the like as a release agent to the roller surface, a cleaning assembly which removes deposits such as offset toner and paper dust having adhered to the fixing roller surface, and a temperature conditioning device which performs temperature control.

A recording medium P serving as the heating object is, keeping its side on which unfixed toner images T have been formed stood the fixing roller 11 side, transported to a pressure contact zone formed between the fixing roller 11, which is kept temperature-controlled to a stated temperature, and the pressure roller 12, and the unfixed toner images are heated and pressed to become fixed onto the recording medium P.

Incidentally, the fixing roller 11 comprises, as the substrate, a mandrel 14 which is cylindrical and made of a metal such as aluminum, and is further provided with an elastic layer 15. On the elastic layer 15, a release layer may optionally be provided which is about 50 μm in thickness and formed of a fluorine resin or the like. Also, in the case when such a roller-shaped heat fixing member is made up, one having a thickness of about 2 mm may be used as the mandrel, and the roller may have an outer diameter of about 60 mm.

Meanwhile, the pressure roller 12 also comprises, like the fixing roller 11, a mandrel made of a metal such as aluminum, and formed thereon an elastic layer and optionally a release layer. That is, the pressure roller 12 may be the same as the fixing roller 11.

Figure 3:
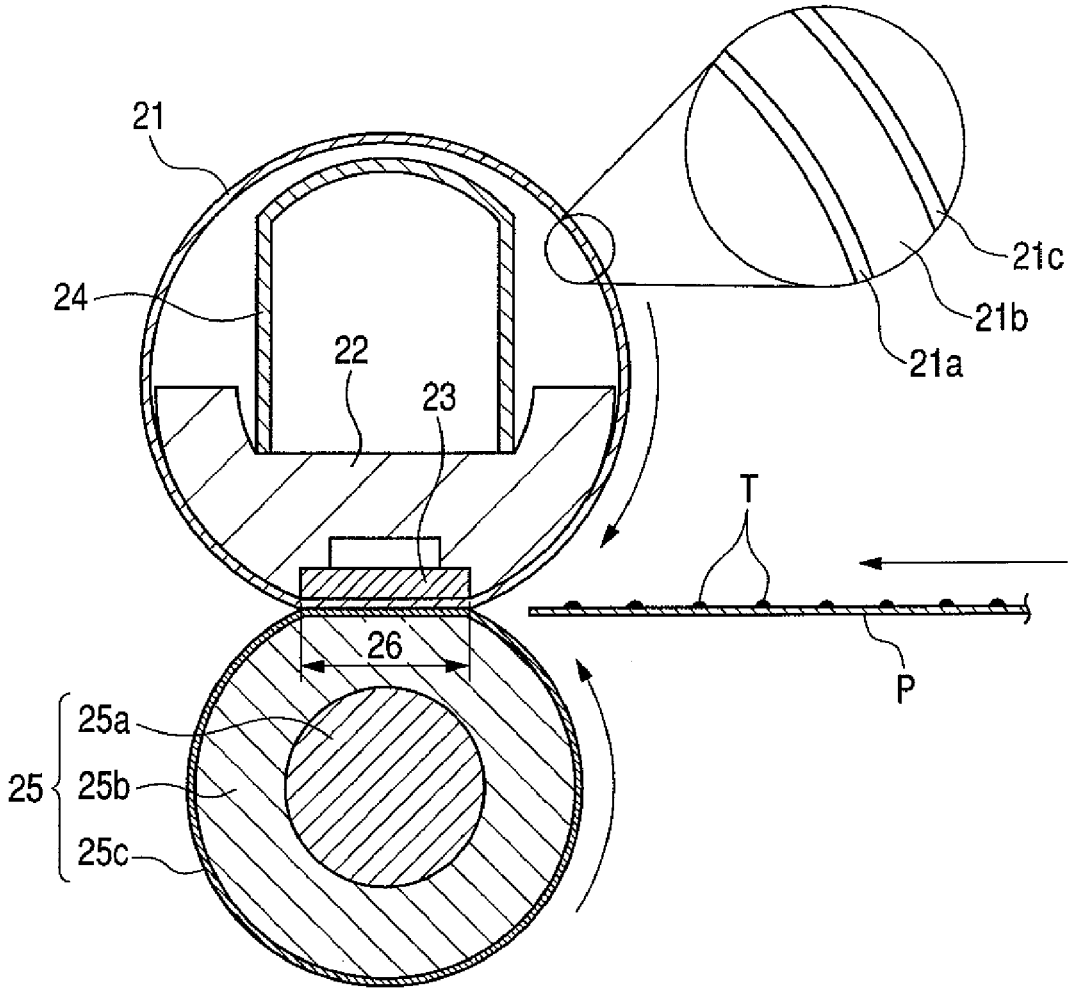
FIG. 3 is a diagrammatic sectional view of a heat fixing assembly making use of a belt-shaped heat fixing member.

In FIG. 3, a heat fixing assembly making use of a belt-shaped heat fixing member is shown as its diagrammatic sectional view.

In this heat fixing assembly, a seamless-form fixing belt 21 as the heat fixing member forms a nip zone 26 between it and a pressure member 25. Then, the fixing belt 21 is provided on its inside with a belt guide member 22 formed by molding a heat-resistant and heat-insulating resin or a ceramic material, in order to hold the fixing belt 21. At the position where this belt guide member 22 and the inner surface of the fixing belt 21 come into contact, a heat source 23 such as a ceramic heater is provided. This heat source 23 is fixedly supported in the state it is fitted into a groove provided over the lengthwise direction of the belt guide member 22, and is made to generate heat upon electrification. Then, the seamless-form fixing belt 21 is loosely externally fitted to the belt guide member 22. A pressing rigid stay 24 is inserted to the belt guide member 22 on its inside.

Incidentally, the heat fixing belt 21 comprises a belt substrate 21*a* and formed on its outer surface an elastic layer 21*b*, and is further covered on its outer surface with a fluorine resin tube 21*c* as a release layer.

The pressure member 25 is an elastic pressure roller, and usually comprises a rod-shaped mandrel 25*a* made of stainless steel or the like, and provided thereon with an elastic layer 25*a* of silicone rubber or the like to make the member have a low hardness. The mandrel 25*a* is rotatably axially supported on its both ends between this side and inner side chassis uprights (not shown). The elastic pressure roller is usually covered with a fluorine resin tube of about 50 μm in thickness as a surface layer 25*c* in order to improve surface properties and releasability.

Between each of both ends of the pressing rigid stay 24 and a spring bearing member (not shown) on the assembly chassis side, a pressure spring (not shown) is provided in a compressed state, whereby a press-down force is kept to act on the pressing rigid stay 24. In virtue of this force, the bottom surface of the ceramic heater 23 provided on the bottom surface of the belt guide member 22 and the top surface of the pressure member 25 are kept in pressure contact interposing the fixing belt 21 between them, where the above fixing nip zone 26 is formed.

The recording medium P serving as the heating object on which unfixed toner images T have been formed is sandwichedly transported to this fixing nip zone 26, whereby the toner images are heated and pressed, and are fixed onto the recording medium.

EXAMPLES

The present invention is described below by giving Examples.

Carbon fibers and other fillers which are used in the following Examples and Comparative Example are shown first.

(Fillers)

01M: Pitch-based carbon fibers; trade name: XN-100-01M; available from Nippon Graphite Fiber Corporation; average fiber diameter D: 5 μm; average fiber length L: 10 μm; number proportion of fibers of 1 to 50 μm in fiber length: 100%; true density: 2.1 g/cm$^3$.

15M: Pitch-based carbon fibers; trade name: XN-100-15M; available from Nippon Graphite Fiber Corporation; average fiber diameter D: 10 μm; average fiber length L: 150 μm; number proportion of fibers of 1 to 50 μm in fiber length: 70%; true density: 2.2 g/cm$^3$.

25M: Pitch-based carbon fibers; trade name: XN-100-25M; available from Nippon Graphite Fiber Corporation; average fiber diameter D: 10 μm; average fiber length L: 250 μm; number proportion of fibers of 1 to 50 μm in fiber length: 10%; true density: 2.2 g/cm$^3$.

A10S: High-purity truly spherical alumina; trade name: ALUNABEADS CB-ALOS; available from Showa Titanium Co.; weight-average particle diameter R: 10 μm.

Example 1

With both-terminal vinylated polydimethylsiloxane (weight-average molecular weight 68,000, in terms of polystyrene), hydrogenorganopolysiloxane having at least two SiH bonds in one molecule was so mixed that SiH group and vinyl groups were in a proportion of 2:1, followed by addition of a catalyst platinum compound to obtain an addition-curable type silicone rubber stock solution having a stock solution viscosity of 6.5 Pa·s (as measured with a V-type rotary viscometer Rotor No. 4 at 60 rpm).

Into this addition-curable type silicone rubber stock solution, pitch-based carbon fibers 01M and pitch-based carbon fibers 25M were uniformly so compounded that these were in proportions of 31.1% and 8.9%, respectively, as volume ratio, followed by kneading to obtain Silicone Rubber Composition 1. The average fiber diameter D of carbon fibers contained in this Silicone Rubber Composition 1 was 6 μm, preferably, and the number proportion of fibers of 1 to 50 μm in fiber length was 80%.

With this Silicone Rubber Composition 1, a belt substrate made of stainless steel SUS304 (thickness: 35 μm; inner diameter: 24 mm) was coated on its outer surface by ring coating in a thickness of 300 μm, followed by heating to cure at 200° C. for 4 hours to form an elastic layer. This was further covered on its outer surface with a PFA (tetrafluoroethylene/perfluoroalkyl vinyl ether copolymer) tube (thickness: 30 μm), and then both ends were cut to obtain Heat Fixing Member 1 having a length of 230 mm in the lengthwise direction.

Incidentally, in a separate course, an elastic layer was formed on the belt substrate in the same manner as the above. This elastic layer was cut out and several layers were so piled as to be in a thickness of 6 mm or more, in the state of which ASKER-C hardness was measured to find that it was 35 degrees. The thermal conductivity in the thickness of this elastic layer cut out was also measured to find that it was 2.3 W/(m·K).

The results are shown in Table 1.

Examples 2 to 9

Comparative Examples 1 and 2

Heat Fixing Members 2 to 9 (Examples) and 10 and 11 (Comparative Examples) were produced in the same manner as in Example 1 except that as carbon fibers or fillers those shown in Table 1 below were used in the fills shown in Table 1. The average fiber diameter D and average fiber length L of carbon fibers contained in each silicone rubber composition, the number proportion of fibers of 1 to 50 μm in fiber length, and the ASKER-C hardness and thickness direction thermal conductivity of the elastic layer of each heat fixing member were measured to obtain the results shown in Table 1.

Comparative Examples 3 and 4

Heat Fixing Members 12 and 13 were produced in the same manner as in Example 1 except that as a filler the one shown in Table 1 below was used in fills shown in Table 1. The ASKER-C hardness and thickness direction thermal conductivity of the elastic layer according to Heat Fixing Members 12 and 13 were measured to obtain the results shown in Table 1.

—Performance Evaluation—

To make performance evaluation, a color laser printer (trade name: LBP-2410, manufactured by CANON INC.) was used in which a heat fixing assembly was set in which each heat fixing member produced as above was set as the fixing belt of the heat fixing assembly shown in FIG. 3. Incidentally, the used pressure member had an outer diameter of 24 mm and the used elastic layer had a thickness of 3 mm.

In the state the pressure member was so rotated in the direction shown by an arrow that its surface movement speed was 200 mm/sec., the ceramic heater was started being electrified, and the outer surface temperature of the heat fixing member at the position of 90° on the upstream side from the fixing nip zone was monitored with a radiation type thermometer (not shown), where the timing of on-off of the power applied to the ceramic heater was controlled to make the outer surface temperature stable at 180° C.

Using the above printer, images were formed on A4 size printing paper (trade name: PB PAPER GF-500, available from CANON INC.; basis weight: 68 g/m$^2$) by using a cyan toner and a magenta toner and substantially over the whole surface at a density of 100%, to obtain images for evaluation. Using the images obtained, their glossiness (75° gloss value) and glossiness uniformity were evaluated. The results of evaluation of these are shown together in Table 1.

Glossiness:

Using a gloss meter PG-3D (angle of incidence/reflection: 75°), manufactured by Nippon Denshoku Industries, Co., Ltd., and using black glass of 96.9 in glossiness as a reference, the glossiness (75° gloss value) was measured at the middle area of evaluation images at the position of 5 cm from the leading end in the paper feed direction.

Gloss Uniformity:

Whether or not any gloss non-uniformity was observable was visually judged by five panelists to make evaluation according to the following criteria.

A: All the five panelists judged "the gloss to be less non-uniform".

B: Four panelists judged "the gloss to be less non-uniform".

C: Three panelists judged "the gloss to be less non-uniform". Within a permissible range.

D: The number of panelists who judged "the gloss to be less non-uniform" was two or less.

TABLE 1

| | | Elastic layer | | | | | | | | | |
|---|---|---|---|---|---|---|---|---|---|---|---|
| | | Filler (s) | | | | | | | | | |
| | Heat fixing member No. | Type | Content (vol. %) | Av. fiber length L (μm) | Av. fiber diam. D (μm) | Number distribution of fiber length 1-50 μm (%) | >50 μm (%) | Thermal conductivity [W/(m · K)] | ASKER-C hardness (deg.) | Evaluation Gloss-iness | Unifor-mity |
| Example: | | | | | | | | | | | |
| 1 | 1 | 01M<br>25M | (31.1)<br>(8.9) | 63 | 6 | 80 | 20 | 2.3 | 35 | 35 | A |
| 2 | 2 | 01M<br>25M | (15.6)<br>(4.4) | 63 | 6 | 80 | 20 | 1.2 | 18 | 17 | A |
| 3 | 3 | 01M<br>15M | (16.0)<br>(16.0) | 80 | 8 | 85 | 15 | 1.5 | 27 | 24 | A |
| 4 | 4 | 01M<br>25M | (36.7)<br>(7.3) | 50 | 6 | 95 | 5 | 2.0 | 39 | 32 | A |
| 5 | 5 | 01M<br>15M | (20.0)<br>(4.0) | 33 | 6 | 95 | 5 | 1.2 | 22 | 18 | A |
| 6 | 6 | 01M | (40.0) | 10 | 5 | 100 | 0 | 1.6 | 19 | 27 | B |
| 7 | 7 | 01M | (30.0) | 10 | 5 | 100 | 0 | 1.1 | 36 | 17 | A |
| 8 | 8 | 01M<br>25M | (7.3)<br>(14.7) | 143 | 8 | 40 | 60 | 1.3 | 48 | 19 | B |
| 9 | 9 | 25M | (22.0) | 250 | 10 | 10 | 90 | 1.4 | 54 | 20 | C |
| Comparative Example: | | | | | | | | | | | |
| 1 | 10 | 01M<br>15M | (6.0)<br>(6.0) | 80 | 8 | 85 | 15 | 0.5 | 14 | 5 | B |
| 2 | 11 | 25M | (10.0) | 250 | 10 | 10 | 90 | 0.6 | 12 | 6 | B |

TABLE 1-continued

| | Heat fixing member No. | Elastic layer: Filler (s) Type | Content (vol. %) | Av. fiber length L (μm) | Av. fiber diam. D (μm) | Number distribution of fiber length 1-50 μm (%) | >50 μm (%) | Thermal conductivity [W/(m · K)] | ASKER-C hardness (deg.) | Evaluation Gloss-iness | Unifor-mity |
|---|---|---|---|---|---|---|---|---|---|---|---|
| 3 | 12 | A10S | (50.0) | — | — | — | — | 1.0 | 67 | 10 | D |
| 4 | 13 | A10S | (30.0) | — | — | — | — | 0.5 | 10 | 5 | B |

In Heat Fixing Member 1 (Example 1), carbon fibers having a relatively short fiber length ranging from 1 to 50 μm are filled in the elastic layer without coming oriented so much, and on the other hand relatively long carbon fibers having a fiber length of more than 50 μm form long heat conduction paths (heat flow paths) in the elastic layer. This has achieved a high thermal conductivity at a relatively low fill, and also has kept the elastic layer from having a high hardness. As the result, the thermal conductivity in the thickness direction of the elastic layer is as very high as 2.3 W/(m·K) to enable supply of sufficient heat to the heating object and the toner images held thereon, so that a superior gloss performance is presented. Further, because of a sufficiently low hardness of the elastic layer, the heat fixing member can follow up the surface unevenness (hills and dales) of the heating object and toner images to secure a very good glossiness uniformity over the whole surface of the heating object.

In Heat Fixing Member 2 (Example 2), the distribution of fiber length of the carbon fibers is kept unchanged and the amounts of carbon fibers are halved so that the flexibility of the elastic layer can be improved compared with Heat Fixing Member 1. The thermal conductivity in the thickness direction of the elastic layer is as sufficient as 1.2 W/(m·K), and very good results are obtained on the gloss performance, in particular, the glossiness uniformity.

In Heat Fixing Member 3 (Example 3), the thermal conductivity in the thickness direction of the elastic layer is 1.5 W/(m·K), the ASKER-C hardness is 27 degrees as being soft, and a sufficient gloss performance and a very good glossiness uniformity have been achieved.

In Heat Fixing Member 4 (Example 4), the thermal conductivity in the thickness direction of the elastic layer is as very high as 2.0 W/(m·K), and the heat fixing member has a sufficient flexibility, so that a superior gloss performance and a very good glossiness uniformity have been secured.

In Heat Fixing Member 5 (Example 5), though not so good as Heat Fixing Member 4, a well superior gloss performance and a very good glossiness uniformity have been achieved.

In Heat Fixing Member 6 (Example 6), carbon fibers composed of only fibers having a relatively short fiber length which hold 100% of those having the fiber length ranging from 1 to 50 μm are used, so that, in spite of their use in a small quantity, the flexibility of the elastic layer, though not so good as in Heat Fixing Members 1 to 5, shows good results.

In Heat Fixing Member 7 (Example 7), the carbon fibers are used in a smaller fill in the elastic layer than that in Heat Fixing Member 6 so that the elastic layer can have a low hardness. A very good glossiness uniformity has been achieved.

In Heat Fixing Member 8 (Example 8) and Heat Fixing Member 9 (Example 9), too, the carbon fibers are mixed in the elastic layer to secure a thermal conductivity in its thickness direction, of 1.0 W/(m·K) or more, and secure the glossiness uniformity within a permissible range while securing a good gloss performance.

On the other hand, in Heat Fixing Member 10 (Comparative Example 1) and Heat Fixing Member 11 (Comparative Example 2), the carbon fibers that serve as heat flow paths are added in small quantities, and hence the thermal conductivity in the thickness direction is not sufficiently secured, so that it has been unable to secure any sufficient gloss performance.

In the case when the heat fixing member 12 produced in Comparative Example 3 is used, aluminum oxide particles are added to the elastic layer in a fill proportion of 50% in order to achieve the desired gloss performance. However, because of a too high hardness, the heat fixing member can not follow up the surface unevenness of the heating object and toner images to have caused gloss non-uniformity.

Further, in Heat Fixing Member 13 (Comparative Example 4), aluminum oxide particles are added to the elastic layer in a fill proportion made smaller to 30% in an attempt to less cause the gloss non-uniformity. However, because of a low thermal conductivity that has resulted from their addition in a lower fill, it has been unable to secure any sufficient gloss performance.

Carbon fibers and orientation inhibitory components which are used in the following Examples and Comparative Examples are shown below.

(Carbon Fibers)

25M: Pitch-based carbon fibers; trade name: XN-100-25M; available from Nippon Graphite Fiber Corporation; average fiber diameter D: 10 μm; average fiber length L: 250 μm; number proportion of fibers of 1 to 50 μm in fiber length: 10%; true density: 2.2 g/cm$^3$.

15M: Pitch-based carbon fibers; trade name: XN-100-15M; available from Nippon Graphite Fiber Corporation; average fiber diameter D: 10 μm; average fiber length L: 150 μm; number proportion of fibers of 1 to 50 μm in fiber length: 70%; true density: 2.2 g/cm$^3$.

10M: Pitch-based carbon fibers; trade name: XN-100-10M; available from Nippon Graphite Fiber Corporation; average fiber diameter D: 10 μm; average fiber length L: 100 μm; number proportion of fibers of 1 to 50 μm in fiber length: 80%; true density: 2.2 g/cm$^3$.

05M: Pitch-based carbon fibers; trade name: XN-100-05M; available from Nippon Graphite Fiber Corporation; average fiber diameter D: 10 μm; average fiber length L: 50 μm; number proportion of fibers of 1 to 50 μm in fiber length: 90%; true density: 2.2 g/cm$^3$.

01M Classified: Obtained by classifying pitch-based carbon fibers (trade name: XN-100-01M; available from Nippon Graphite Fiber Corporation; average fiber diameter D: 5 μm; average fiber length L: 10 μm; number proportion of fibers of 1 to 50 μm in fiber length: 100%; true density: 2.1 g/cm$^3$);

average fiber diameter D: 3 μm; average fiber length L: 5 μm; number proportion of fibers of 1 to 50 μm in fiber length: 100%; true density: 2.1 g/cm$^3$.

(Orientation Inhibitory Component)

A50S: Aluminum oxide particles; trade name: high-purity truly spherical alumina ALUNABEADS CB-A50S; available from Showa Titanium Co.; weight-average particle diameter R: 50 μm.

A30S: Aluminum oxide particles; trade name: high-purity truly spherical alumina ALUNABEADS CB-A30S; available from Showa Titanium Co.; weight-average particle diameter R: 30 μm.

A10S: Aluminum oxide particles; trade name: high-purity truly spherical alumina ALUNABEADS CB-ALOS; available from Showa Titanium Co.; weight-average particle diameter R: 10 μM.

A50S Classified: Obtained by classifying aluminum oxide particles A50S; weight-average particle diameter R: 45 μm.

A10 Classified: Obtained by classifying aluminum oxide particles (trade name: high-purity truly spherical alumina ALUNABEADS CB-A10; available from Showa Titanium Co.; weight-average particle diameter R: 10 μm); weight-average particle diameter R: 5 μm.

A05S Classified-3: Obtained by classifying aluminum oxide particles (trade name: high-purity truly spherical alumina ALUNABEADS CB-A05S; available from Showa Titanium Co.; weight-average particle diameter R: 3 μm); weight-average particle diameter R: 3 μm.

A05S Classified-2: Obtained by classifying aluminum oxide particles (trade name: high-purity truly spherical alumina ALUNABEADS CB-A05S; available from Showa Titanium Co.; weight-average particle diameter R: 3 μm); weight-average particle diameter R: 2 μm.

WZ: Zinc oxide whiskers; trade name: PANA-TETRA WZ-0501; available from Matsushita Amtec Co.; weight-average particle diameter R: 25 μm.

Example 10

With both-terminal vinylated polydimethylsiloxane (weight-average molecular weight 68,000, in terms of polystyrene), hydrogenorganopolysiloxane having at least two SiH bonds in one molecule was so mixed that SiH group and vinyl groups were in a proportion of 2:1, followed by addition of a catalyst platinum compound to obtain an addition-curable type silicone rubber stock solution having a stock solution viscosity of 6.5 Pa·s (as measured with a V-type rotary viscometer Rotor No. 4 at 60 rpm).

Into this addition-curable type silicone rubber stock solution, carbon fibers 15M and also aluminum oxide particles A05S were uniformly so compounded that these were in proportions of 30% and 20%, respectively, as volume ratio, followed by kneading to obtain a silicone rubber composition.

With this silicone rubber composition, a belt substrate made of stainless steel SUS304 (thickness: 35 μm; inner diameter: 24 mm) was coated on its outer surface by ring coating in a thickness of 300 μm, followed by heating to cure at 200° C. for 4 hours to form an elastic layer. This was further covered on its outer surface with a PFA (tetrafluoroethylene/perfluoroalkyl vinyl ether copolymer) tube (thickness: 30 μm), and then both ends were cut to obtain Heat Fixing Member 15 having a length of 230 mm.

Incidentally, in a separate course, an elastic layer was formed on the belt substrate in the same manner as the above, to produce a heat fixing member standing before it was covered with the fluorine resin tube. This elastic layer was cut out and several layers were so piled as to be in a thickness of 6 mm or more, in the state of which ASKER-C hardness was measured to find that it was 39 degrees. The thermal conductivity in the thickness direction of this elastic layer cut out was also measured to find that it was 2.2 W/(m·K).

The results are shown in Table 1.

Examples 11 to 16 & Comparative Examples 5 to 8

Silicone rubber compositions were prepared and Heat Fixing Members 16 to 25 were further produced in the same manner as in Example 10 except that, as carbon fibers and orientation inhibitory components, those shown in Table 2 below were compounded in the amounts shown in Table 2. The ASKER-C hardness and thermal conductivity of the elastic layer of each of these heat fixing members were also measured to obtain the results shown in Table 2.

In regard to the heat fixing members of the above Examples 11 to 16 and Comparative Examples 5 to 8, evaluation was made in the same way as in Example 1. The results of evaluation are shown together in Table 2.

TABLE 2

| | Heat fixing Evaluation member No. | Elastic layer: Carbon fibers: Type | Content (vol. %) | L (μm) | D (μm) | Number distribution of fiber length 1-50 μm (%) | >50 μm (%) | Orientation inhibitory component: Type | Content (vol. %) | R (μm) | R/D | Thermal conductivity [W/(m • K)] | ASK | Gl. | Uniformity |
|---|---|---|---|---|---|---|---|---|---|---|---|---|---|---|---|
| Example: | | | | | | | | | | | | | | | |
| 10 | 15 | 15M | (30) | 150 | 10 | 70 | 30 | A50S | (20) | 50 | 5 | 2.2 | 39 | 34 | A |
| 11 | 16 | 15M | (20) | 150 | 10 | 70 | 30 | A50S | (30) | 50 | 5 | 2.1 | 38 | 33 | A |
| 12 | 17 | 05M | (10) | 50 | 10 | 90 | 10 | A30S | (40) | 30 | 3 | 1.4 | 35 | 23 | A |
| 13 | 18 | 25M | (10) | 250 | 10 | 10 | 90 | A10S | (15) | 10 | 1 | 1.0 | 30 | 20 | A |
| Comparative Example: | | | | | | | | | | | | | | | |
| 5 | 19 | 01M* | (10) | 5 | 3 | 100 | 0 | A30S | (15) | 30 | 10 | 0.8 | 25 | 14 | A |
| 6 | 20 | 25M | (13) | 250 | 10 | 10 | 90 | A10* | (20) | 5 | 0.5 | 0.8 | 35 | 13 | A |
| Example: | | | | | | | | | | | | | | | |
| 14 | 21 | 05M | (30) | 50 | 10 | 90 | 10 | A05S*3 | (30) | 3 | 0.3 | 2.0 | 54 | 30 | C |
| 15 | 22 | 01M* | (25) | 5 | 3 | 100 | 0 | A50S* | (10) | 45 | 15 | 1.3 | 52 | 19 | C |

TABLE 2-continued

| | Heat fixing Evaluation member No. | Elastic layer: Carbon fibers Type | Content (vol. %) | L (μm) | D (μm) | Number distribution of fiber length 1-50 μm (%) | >50 μm (%) | Orientation inhibitory component Type | Content (vol. %) | R (μm) | R/D | Thermal conductivity [W/(m • K)] | ASK | Gl. | Uniformity |
|---|---|---|---|---|---|---|---|---|---|---|---|---|---|---|---|
| Comparative Example: | | | | | | | | | | | | | | | |
| 7 | 23 | 01M* | (20) | 5 | 3 | 100 | 0 | A50S* | (5) | 45 | 15 | 0.8 | 45 | 12 | B |
| 8 | 24 | 10M | (30) | 100 | 10 | 80 | 20 | A05S*2 | (20) | 2 | 0.2 | 0.8 | 51 | 11 | C |
| Example: | | | | | | | | | | | | | | | |
| 16 | 25 | 05M | (30) | 50 | 10 | 90 | 10 | WZ | (5) | 25 | 2.5 | 1.1 | 55 | 20 | C |

L: Average fiber length L
D: Average fiber diameter D
R: Average particle diameter R
ASK: ASKER-C hardness (degrees)
Gl.: Glossiness
*: Classified
*3: Classified-3
*2: Classified-2

In Heat Fixing Member 15 (Example 10), the compounding of carbon fibers and alumina particles and the relationship between fiber diameter and particle diameter (R/D=5) are proper, and it is considered that the alumina particles have effectively kept the carbon fibers from coming oriented and hence the thermal conductivity in the thickness direction of the elastic layer has come as very high as 2.2 W/(m·K). This enables supply of sufficient heat to the heating object and the toner images held thereon, so that a superior gloss performance can be presented. Also, it has turned out that, because of a sufficiently low hardness of the elastic layer, as being sufficiently soft, the heat fixing member can follow up the surface unevenness (hills and dales) of the heating object and toner images to consequently secure a very good glossiness uniformity over the whole surface of the heating object.

In Heat Fixing Member 16 (Example 11), the types and total volume fills of carbon fibers and alumina particles are maintained the same as in Heat Fixing Member 15, but their compounding proportion is changed. As the result, the thermal conductivity in the thickness direction of the elastic layer is sufficiently as high as 2.1 W/(m·K), the gloss performance is also at a superior level, the elastic layer is sufficiently soft, and the glossiness uniformity over the whole surface of the heating object is also very good.

In Heat Fixing Member 17 (Example 12), alumina particles and carbon fibers standing the relation of R/D=3 are compounded as above, and hence the thermal conductivity in the thickness direction of the elastic layer is somewhat low [1.4 W/(m·K)], but the ASKER-C hardness is 35 degrees, and the images obtained has achieved a sufficiently superior gloss performance and attained a very good glossiness uniformity.

In Heat Fixing Member 18 (Example 13), alumina particles and carbon fibers standing the relation of R/D=1 are compounded as shown in Table 2, and hence the filler that secures heat conduction is used in a smaller quantity, so that the thermal conductivity in the thickness direction of the elastic layer is somewhat as low as 1.0 W/(m·K). However, the ASKER-C hardness is sufficiently as low as 30 degrees, and, because of the relationship between thermal conductivity and flexibility, a superior gloss performance and a very good glossiness uniformity have been secured.

In Heat Fixing Member 19 (Comparative Example 5) and Heat Fixing Member 20 (Comparative Example 6), the thermal conductivity in the thickness direction does not attain the desired value in both cases. In regard to gloss performance as well, it is inferior.

In Heat Fixing Member 21 (Example 14), used are those in which carbon fibers and alumina particles compounded are in a range of R/D=0.3, which is outside the desired relation $0.5 \leqq R/D \leqq 10$, and hence the area of interfaces between the alumina particles and the silicone rubber has come large. As the result, the flexibility of the elastic layer is not so good as that of Heat Fixing Members 15 to 20. However, because of a high thermal conductivity, good results are obtained in respect of the gloss performance, and the evaluation of glossiness uniformity is also within a permissible range.

In Heat Fixing Member 22 (Example 15) as well, carbon fibers and alumina particles are in a range of R/D=15, which is outside the desired relation $0.5 \leqq R/D \leqq 10$, and hence the area of interfaces between the carbon fibers and the silicone rubber has come large. As the result, the flexibility of the elastic layer is not so good as that of Heat Fixing Members 15 to 20. However, in respect of the gloss performance, it is at a sufficient level, and the evaluation of glossiness uniformity is also within a permissible range.

In the cases when Heat Fixing Member 23 (Comparative Example 7) and Heat Fixing Member 24 (Comparative Example 8) are used, too, carbon fibers and aluminium oxide particles are in ranges outside the desired relation $0.5 \leqq R/D \leqq 10$, and the compounding of these as shown in Table 2 does not bring the thermal conductivity of the elastic layer to attain the desired value. In regard to gloss performance as well, it is inferior.

In Heat Fixing Member 25 (Example 16), tetrapod-shaped zinc oxide whiskers (WZ) are used as the carbon fiber orientation inhibitory component, where the thermal conductivity and flexibility of the elastic layer have secured the desired levels to achieve a sufficiently superior gloss performance and a very good glossiness uniformity.

As can be seen from the foregoing Examples and Comparative Examples, the seamless-type heat fixing member having the elastic layer in which the carbon fibers are mixed and the thermal conductivity in the thickness direction of which is 1.0 W/(m·K) or more can achieve, as a heat fixing member of a heat fixing assembly, a good image uniformity while securing a high gloss performance of fixed images at the time of high-speed printing.

Moreover, how the carbon fibers are compounded may be controlled, and this enables designing of elastic layers having a higher thermal conductivity and also having a lower hardness, making it possible to obtain a heat fixing assembly which can simultaneously achieve superior gloss performance and image uniformity.

The orientation inhibitory component may also be compounded together with the carbon fibers to inhibit the carbon fibers from coming oriented, and this makes it possible to obtain a heat fixing assembly which can promise images having much better gloss performance.

This application claims priority from Japanese Patent Application Nos. 2005-043905 filed on Feb. 21, 2005 and 2005-043984 filed on Feb. 21, 2005, which are hereby incorporated by reference herein.

What is claimed is:

1. A seamless cylindrical heat fixing member comprising:

a seamless cylindrical substrate; and an elastic layer formed on said seamless cylindrical substrate, wherein said elastic layer comprises rubber and carbon fibers, wherein said elastic layer has thermal conductivity of 1.0 W/(m·K) or more in a thickness direction of said elastic layer, and wherein said carbon fibers have an average fiber length of 1 μm or greater, with the carbon fibers whose length fall in the range of 1-50 μm in a range of 80-95% by number.

2. The heat fixing member according to claim 1, wherein said carbon fibers' average length is larger than the average diameter thereof.

3. The heat fixing member according to claim 1, wherein the thermal conductivity is 2.0 W/(m·K) or more.

4. The heat fixing member according to claim 1, wherein the total content of the carbon fibers in said elastic layer ranges 20-44 vol. %.

5. The heat fixing member according to claim 1, wherein said carbon fibers are pitch-based carbon fibers.

6. The heat fixing member according to claim 1, wherein said carbon fibers have a true density of 2.1 g/cm$^3$ or more.

7. A heat fixing assembly comprising:

a seamless fixing belt;

a belt guide member provided inside of said seamless fixing belt;

a pressure roller forming a nip with said seamless fixing belt; and a heater provided at a position where said belt guide member and an inner surface of said seamless fixing belt come into contact, wherein said seamless fixing belt is a seamless cylindrical heat fixing member comprising:

a seamless cylindrical substrate; and an elastic layer formed on said seamless cylindrical substrate, wherein said elastic layer comprises rubber and carbon fibers, wherein said elastic layer has thermal conductivity of 1.0 W/(m·K) or more in a thickness direction of said elastic layer, and wherein said carbon fibers have an average fiber length of 1 μm or greater, with the carbon fibers whose length fall in the range of 1-50 μm in a range of 80-95% by number.

* * * * *